US011112712B2

(12) United States Patent
Matsunaga et al.

(10) Patent No.: US 11,112,712 B2
(45) Date of Patent: Sep. 7, 2021

(54) TONER

(71) Applicant: CANON KABUSHIKI KAISHA, Tokyo (JP)

(72) Inventors: Tomonori Matsunaga, Suntou-gun (JP); Hidekazu Fumita, Gotemba (JP); Noriyoshi Umeda, Suntou-gun (JP); Shohei Tsuda, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/815,377

(22) Filed: Mar. 11, 2020

(65) Prior Publication Data

US 2020/0292955 A1 Sep. 17, 2020

(30) Foreign Application Priority Data

Mar. 15, 2019 (JP) ..... JP2019-048540
Feb. 4, 2020 (JP) ..... JP2020-017058

(51) Int. Cl.
*G03G 9/08* (2006.01)
*G03G 9/087* (2006.01)
(Continued)

(52) U.S. Cl.
CPC ..... *G03G 9/08773* (2013.01); *G03G 9/0819* (2013.01); *G03G 9/0825* (2013.01);
(Continued)

(58) Field of Classification Search
CPC .. G03G 9/0819; G03G 9/0827; G03G 9/0825; G03G 9/09725; G03G 9/09716; G03G 9/1136
(Continued)

(56) References Cited

U.S. PATENT DOCUMENTS 6,627,374 B2 9/2003 Fumita et al.
6,835,521 B2 12/2004 Tsuji et al.
(Continued)

FOREIGN PATENT DOCUMENTS

JP 2009-036980 2/2009
JP 2016-021041 2/2016

OTHER PUBLICATIONS

U.S. Appl. No. 16/728,060, Kentaro Yamawaki, filed Dec. 27, 2019.
(Continued)

*Primary Examiner* — Mark A Chapman
(74) *Attorney, Agent, or Firm* — Venable LLP

(57) ABSTRACT

A toner comprising: a toner particle that contains a release agent-containing toner base particle, and an organosilicon polymer on a toner base particle surface, and an external additive A, the organosilicon polymer has a T3 unit structure; the organosilicon polymer forms protruded portions on the toner base particle surface; the number-average value of the protrusion height H is from 30 nm to 300 nm; the ratio of the number-average primary particle diameter R of the external additive A to the number-average value of the protrusion height H is from 1.00 to 4.00; the number-average primary particle diameter R of the external additive A is from 30 nm to 1,200 nm; and, in an image obtained by observing the toner surface with SEM, the area percentage for the bright region area in the image with reference to the total area of the image is from 30.0% to 75.0%.

5 Claims, 2 Drawing Sheets

(51) Int. Cl.
*G03G 9/097* (2006.01)
*G03G 9/113* (2006.01)

(52) U.S. Cl.
CPC ..... *G03G 9/0827* (2013.01); *G03G 9/09716* (2013.01); *G03G 9/09725* (2013.01); *G03G 9/1136* (2013.01)

(58) Field of Classification Search
USPC ..... 430/108.3, 108.7, 110.1, 110.3
See application file for complete search history.

(56) References Cited

U.S. PATENT DOCUMENTS 6,951,704 B2 10/2005 Tsuji et al.
7,135,263 B2 11/2006 Kawakami et al.
7,611,813 B2 11/2009 Ida et al.
7,611,816 B2 11/2009 Tuji et al.
7,767,370 B2 8/2010 Ishigami et al.
7,906,262 B2 3/2011 Ishigami et al.
8,043,781 B2 10/2011 Imafuku et al.
8,114,562 B2 2/2012 Ishigami et al.
8,545,133 B2 10/2013 Fumita et al.
8,916,319 B2 12/2014 Ikeda et al.
8,940,467 B2 1/2015 Hashimoto et al.
9,261,806 B2 2/2016 Moribe et al.
9,285,697 B2 3/2016 Fukudome et al.
9,366,981 B2 6/2016 Yamawaki et al.
9,470,993 B2 10/2016 Nishikawa et al.
9,575,425 B2 2/2017 Naka et al.
9,588,450 B2 3/2017 Tsuda et al.
9,606,462 B2 3/2017 Nomura et al.
9,632,441 B2 4/2017 Abe et al.
9,658,546 B2 5/2017 Tanaka et al.
9,715,188 B2 7/2017 Terauchi et al.
9,772,570 B2 9/2017 Tsuda et al.
9,778,583 B2 10/2017 Terauchi et al.
9,785,068 B2 10/2017 Umeda et al.
9,857,707 B2 1/2018 Tsuda et al.
9,904,195 B2 2/2018 Matsui et al.
10,012,919 B2 7/2018 Matsui et al.
10,054,866 B2 8/2018 Tanaka et al.
10,156,800 B2 12/2018 Tsuda et al.
10,197,934 B2 2/2019 Matsui et al.
10,303,074 B2 5/2019 Yamawaki et al.
10,429,757 B2 10/2019 Yoshida et al.
10,503,090 B2 12/2019 Tominaga et al.
10,545,422 B2 1/2020 Yamawaki et al.
10,578,990 B2 3/2020 Tsuda et al.
10,678,155 B2 * 6/2020 Terui ..... G03G 9/09307
10,747,133 B2 * 8/2020 Yagi ..... G03G 9/0904
2010/0248126 A1 9/2010 Ishigami et al.
2011/0097661 A1 4/2011 Ishigami et al.
2012/0094225 A1 4/2012 Ishigami et al.
2015/0003875 A1 1/2015 Ishigami et al.
2015/0125790 A1 5/2015 Hotta et al.
2019/0041762 A1 2/2019 Yoshiba et al.
2019/0332024 A1 10/2019 Umeda et al.
2020/0026208 A1 1/2020 Terui et al.
2020/0026209 A1 1/2020 Yagi et al.
2020/0124998 A1 4/2020 Kototani et al.
2020/0124999 A1 4/2020 Tanaka et al.
2020/0142329 A1 5/2020 Yamawaki et al.
2020/0166861 A1 5/2020 Uratani et al.

OTHER PUBLICATIONS

U.S. Appl. No. 16/911,556, Hidekazu Fumita, filed Jun. 25, 2020.
U.S. Appl. No. 16/911,929, Shohei Tsuda, filed Jun. 25, 2020.

* cited by examiner

TONER

BACKGROUND OF THE INVENTION

Field of the Invention

The present disclosure relates to the toner used in image-forming methods such as electrophotographic methods.

Description of the Related Art

Size reduction and longer life are being required of electrophotographic image-forming apparatuses, and in response to these additional improvements in various properties are also being required of toner.

Reducing the space taken up by the individual units has been investigated with regard to size reduction. In particular, the waste toner container, which recovers the untransferred toner on the photosensitive drum, can be reduced in size through improvements in toner transferability, and various investigations into improving the transferability have been carried out as a result.

The toner on the photosensitive drum is transferred to the media, e.g., paper, in the transfer step. In order to improve the transferability, the attachment force between the photosensitive drum and toner must be lowered in order to facilitate separation of the toner from the photosensitive drum. The external addition of a large-diameter external additive with a particle diameter of a range from about 100 nm to 300 nm is known as art for accomplishing this.

However, while this is an art effective as a method for improving the transfer efficiency, during long-term image output the ability of a large-diameter external additive to function as a spacer is reduced due to migration, detachment, and burial. As a consequence, it is difficult to stably obtain the expected effect with regard to improving the transfer efficiency.

A method is thus proposed in Japanese Patent Application Laid-open No. 2009-036980 in which external additive migration and detachment are suppressed by bringing about a semi-embedding of a large-diameter external additive.

SUMMARY OF THE INVENTION

The method described in Japanese Patent Application Laid-open No. 2009-036980 can suppress migration and detachment; however, a problem with this method has been that burial ends up being accelerated.

In order to achieve improvements in transferability by methods other than external addition, investigations have also been carried out with respect to methods in which the toner particle surface is coated with an organosilicon compound.

For example, Japanese Patent Application Laid-open No. 2016-021041 discloses a toner that contains, at its surface layer, an organosilicon polymer that has a substructure represented by $R—Si(O_{1/2})_3$.

With this toner, it is thought that an effect of the organosilicon compound that coats the toner particle surface is to provide an excellent resistance to external additive burial.

However, the determination was made that there is still room for improvement in order to realize an even longer toner service life.

An acceleration of burial in the latter half of durability testing is facilitated as a result of the semi-burial caused in the case of Japanese Patent Application Laid-open No. 2009-036980.

In the case of Japanese Patent Application Laid-open No. 2016-021041, on the other hand, separation to the toner particle surface of the internally resident wax, which serves as a release agent, is impeded at a high coating ratio for the organosilicon polymer that coats the toner particle surface. A decline in the low-temperature fixability is facilitated as a result.

Conversely, a satisfactory expression of the spacer effect during initial use is hindered at a low coating ratio for the organosilicon polymer that coats the toner particle surface. The long-term maintenance of the spacer effect is also hindered, and there is room for improvement with regard to maintaining a high transfer efficiency.

Moreover, when a large-diameter external additive is used with a toner that has a low coating ratio by the organosilicon polymer, the occurrence of pass-through during cleaning of the untransferred toner on the intermediate transfer member is facilitated.

The present disclosure thus provides a toner that exhibits an excellent low-temperature fixability and that maintains, both during initial use and long-term use, a high transfer efficiency.

As a result of intensive investigations, the present inventors discovered that a toner that solves this problem is obtained by forming protruded portions on the toner particle surface and controlling the shape of these protruded portions and the diameter of an external additive A.

That is, the toner of the present disclosure is a toner comprising:

a toner particle that contains a release agent-containing toner base particle, and an organosilicon polymer on a surface of the toner base particle, and an external additive A, wherein the organosilicon polymer has a T3 unit structure as represented by $R—Si(O_{1/2})_3$, wherein R represents an alkyl group having from 1 to 6 carbons or represents a phenyl group;

the organosilicon polymer forms protruded portions on the surface of the toner base particle;

in an extended image of a toner cross-sectional image obtained with a scanning transmission electron microscope, wherein the extended image of this cross-sectional image is provided by extending, into a straight line, a line along the circumference of the surface of the toner base particle, and using, with reference to this extended image, a protrusion width w for the length of the line along the circumference for a segment where a protruded portion and the toner base particle form a continuous interface;

a protrusion diameter D for the maximum length of the protruded portion in the direction normal to the protrusion width w; and a protrusion height H for the length, in the line segment that forms the protrusion diameter D, from the peak of the protruded portion to the line along the circumference, the number-average value of the protrusion height H is from 30 nm to 300 nm;

the ratio of the number-average primary particle diameter R of the external additive A to the number-average value of the protrusion height H is from 1.00 to 4.00;

the number-average primary particle diameter R of the external additive A is from 30 nm to 1,200 nm; and in an image obtained by observing the surface of the toner with a scanning electron microscope, acquiring the backscattered electron image for a 1.5-μm square of the surface of the toner, and binarizing whereby the organosilicon polymer regions in the backscattered electron image become bright regions, the area percentage for the bright region area in the image with reference to the total area of the image is from 30.0% to 75.0%.

According to the present disclosure, a toner that exhibits an excellent low-temperature fixability and that maintains, both during initial use and long-term use, a high transfer efficiency can be provided.

Further features of the present invention will become apparent from the following description of exemplary embodiments with reference to the attached drawings.

DESCRIPTION OF THE EMBODIMENTS

Figure 1:
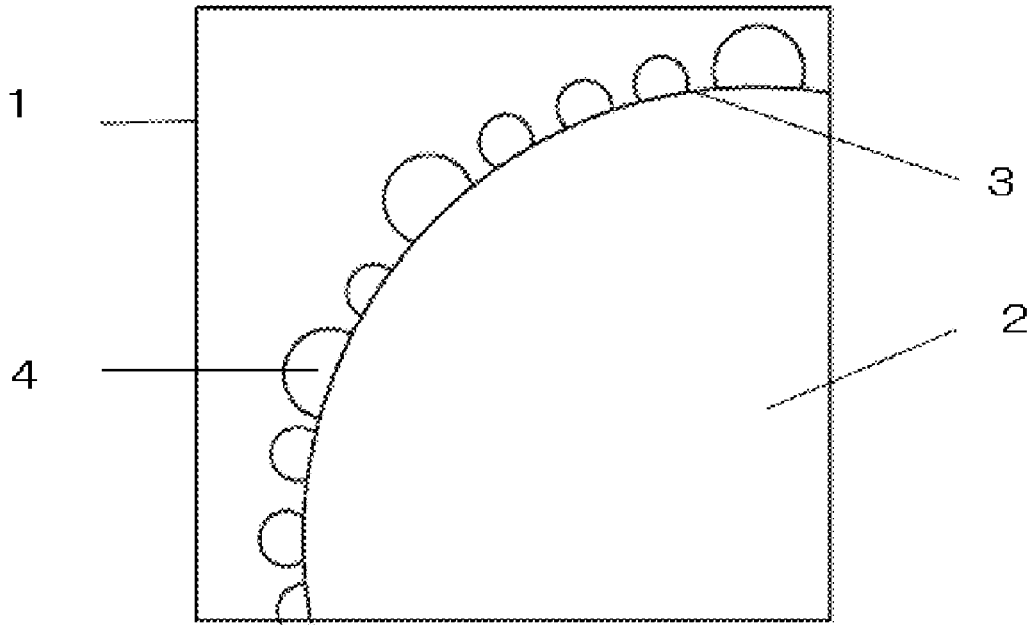
FIG. 1 is a schematic diagram of a toner cross section as observed with a STEM.

Unless specifically indicated otherwise, the expressions "from XX to YY" and "XX to YY" that show numerical value ranges refer in the present invention to numerical value ranges that include the lower limit and upper limit that are the end points.

While embodiments are described in the following, the present disclosure is not limited to or by the following embodiments.

The toner comprises an external additive A and a toner particle that contains a release agent-containing toner base particle, and an organosilicon polymer on a surface of the toner base particle.

The organosilicon polymer has a T3 unit structure as represented by $R—Si(O_{1/2})_3$, wherein R represents an alkyl group having from 1 to 6 carbons or represents a phenyl group.

The organosilicon polymer forms protruded portions on the surface of the toner base particle;

in an extended image of a toner cross-sectional image obtained with a scanning transmission electron microscope, wherein the extended image of this cross-sectional image is provided by extending, into a straight line, a line along the circumference of the surface of the toner base particle, and using, with reference to this extended image, a protrusion width w for the length of the line along the circumference for a segment where a protruded portion and the toner base particle form a continuous interface;

a protrusion diameter D for the maximum length of the protruded portion in the direction normal to the protrusion width w; and a protrusion height H for the length, in the line segment that forms the protrusion diameter D, from the peak of the protruded portion to the line along the circumference, the number-average value of the protrusion height H is from 30 nm to 300 nm.

The ratio of the number-average primary particle diameter R of the external additive A to the number-average value of the protrusion height H is from 1.00 to 4.00, and the number-average primary particle diameter R of the external additive A is from 30 nm to 1,200 nm.

In an image obtained by observing the surface of the toner with a scanning electron microscope, acquiring the backscattered electron image for a 1.5-μm square of the surface of the toner, and binarizing whereby the organosilicon polymer regions in the backscattered electron image become bright regions, the area percentage for the bright region area in the image with reference to the total area of the image is from 30.0% to 75.0%.

A characteristic feature of the aforementioned protruded portions is that they are engaged in surface contact with the surface of the toner base particle; this surface contact can be expected to provide a substantial inhibitory effect on the migration, detachment, and burial of the protruded portions.

Observations of the toner cross section were performed using a scanning transmission electron microscope (also abbreviated as STEM in the following) in order to show the degree of surface contact. FIG. 1 to FIG. 4 provide schematic diagrams of these protruded portions.

The 1 given in FIG. 1 is a STEM image. This image shows an approximately one-quarter section of a toner particle, wherein 2 is a toner particle, 3 is the surface of the toner base particle, and 4 is a protruded portion. In FIG. 2 to FIG. 4, 5 is the protrusion width w, 6 is the protrusion diameter D, and 7 is the protrusion height H.

The cross-sectional image of the toner is observed and a line is drawn along the circumference of the surface of the toner base particle. This line along the circumference is extended into a straight line to provide an extended image. The protrusion width w is the length of the line along the circumference for a segment where a protruded portion and the toner base particle form a continuous interface.

In addition, the protrusion diameter D is the maximum length of the protruded portion in the direction perpendicular to the protrusion width w, and the protrusion height H is the length, in the line segment that forms the protrusion diameter D, from the apex of the protruded portion to the line along the circumference.

Figure 2:
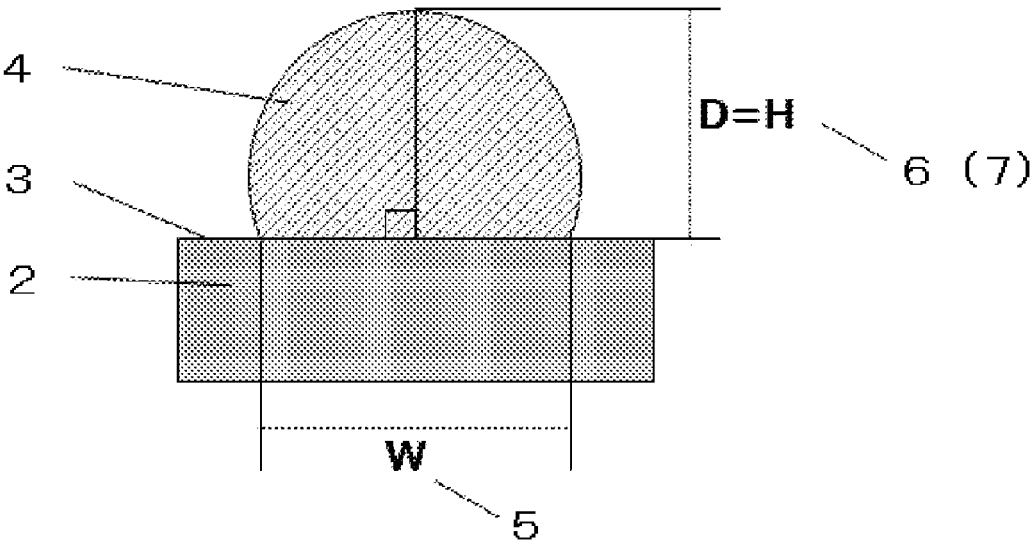
FIG. 2 is a schematic diagram that shows a methodology for measuring the protrusion shape on toner.
Figure 3:
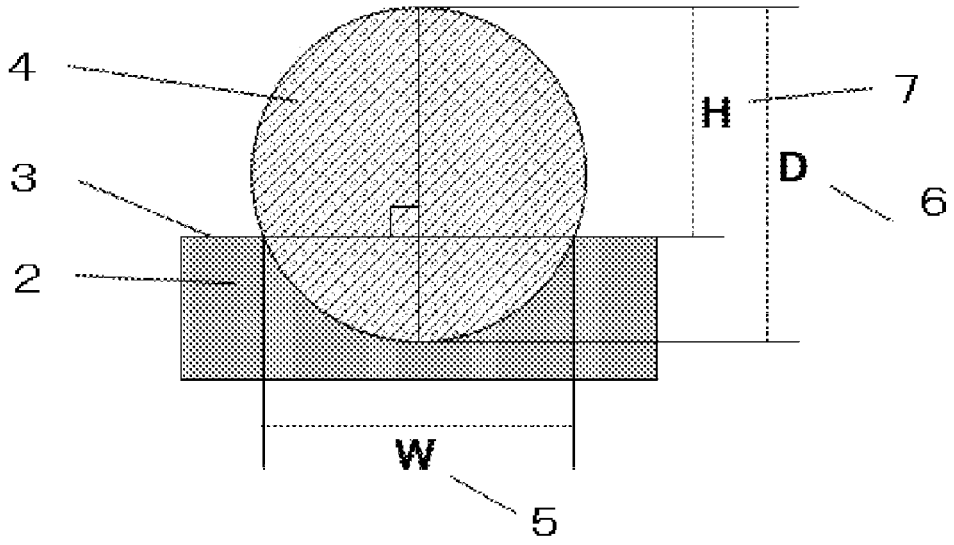
FIG. 3 is a schematic diagram that shows a methodology for measuring the protrusion shape on toner.
Figure 4:
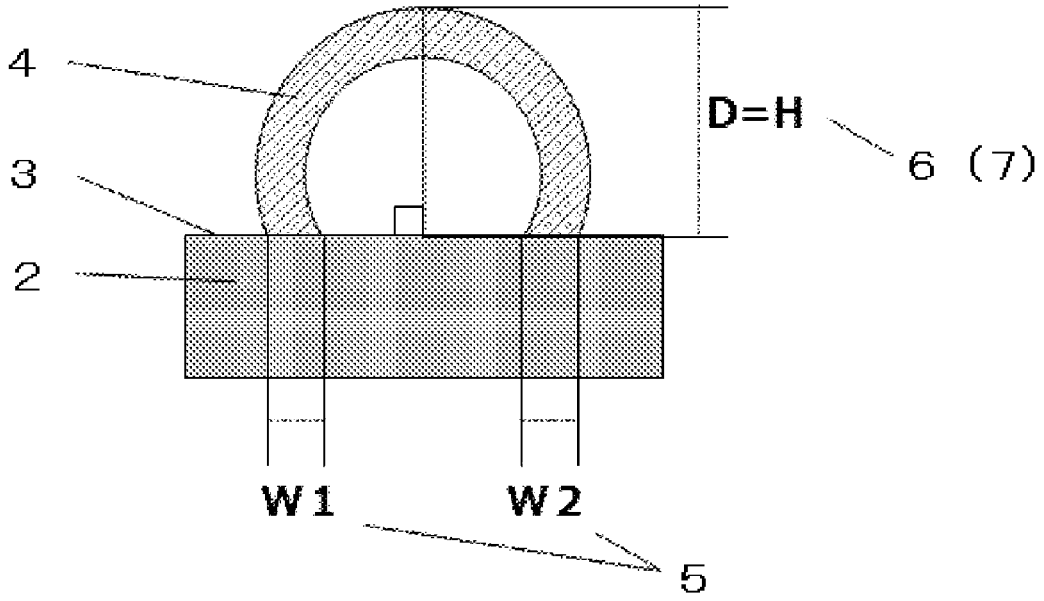
FIG. 4 is a schematic diagram that shows a methodology for measuring the protrusion shape on toner.

In FIG. 2 and FIG. 4, the protrusion diameter D and protrusion height H are the same, while in FIG. 3 the protrusion diameter D is larger than the protrusion height H.

FIG. 4 schematically shows the fixed state for a particle resembling a bowl-shaped particle, in which the central part of a hemispherical particle is recessed, as obtained by crushing and dividing a hollow particle.

In FIG. 4, the protrusion width w is the sum of the lengths of the organosilicon polymer in contact with the surface of the toner base particle. The protrusion width win FIG. 4 is thus the sum of w1 and w2.

The number-average value of the protrusion height H is from 30 nm to 300 nm and is preferably from 30 nm to 200 nm, more preferably from 30 nm to 100 nm, and still more preferably from 30 nm to 80 nm.

When the number-average value of the protrusion height H is at least 30 nm, a spacer effect is then produced between the surface of the toner base particle and the transfer member and the transferability is significantly improved.

When, on the other hand, the number-average value of the protrusion height H is not more than 300 nm, a substantial inhibitory effect on migration, detachment, and burial then occurs and a high transferability is maintained even during long-term use.

The number-average primary particle diameter R of the external additive A is from 30 nm to 1,200 nm.

Having this R be at least 30 nm results in the occurrence of a spacer effect with the transfer member and the appearance of a high transferability. In addition, the transfer performance assumes an increasing trend as R is larger.

An R above 1,200 nm, on the other hand, results in a reduction in toner flowability and facilitates the generation of image nonuniformity. It also facilitates the appearance of poor wiping of the untransferred toner on the photosensitive drum.

The number-average primary particle diameter R of the external additive A is preferably from 30 nm to 1,000 nm, more preferably from 30 nm to 500 nm, and still more preferably from 30 nm to 300 nm.

The ratio of the number-average primary particle diameter R of the external additive A to the number-average value of the protrusion height H is from 1.00 to 4.00. When this ratio [(number-average primary particle diameter R of external additive A)/(number-average value of protrusion height H)] is in the indicated range, the low-temperature fixability can then co-exist in good balance with a transferability that exhibits an excellent tolerance for a longer service life.

This ratio is preferably from 1.00 to 3.80, more preferably from 1.00 to 3.70, and still more preferably from 1.00 to 3.00.

When the number-average value of the protrusion height H is the minimum value of 30 nm, a spacer effect with the transfer member is exhibited and the transferability can be enhanced when R is at least 30 nm. It is thought in this regard that, in those locations where a protruded portion is not present due the effects of, e.g., detachment, the external additive A functions as a substitute and the spacer effect is expressed. Thus, when R is less than 30 nm, the appearance of the spacer effect is impeded.

The fixing percentage for the external additive A on the toner particle surface is preferably from 0% to 20% and is more preferably from 0% to 10%.

By having this fixing percentage be in the indicated range, the external additive A can then easily move over the toner particle surface and the transferability can be further enhanced through a protruded portion-substitute activity.

This fixing percentage can be controlled into the indicated range through adjustment of the rotation rate and treatment temperature at the mixer used when the external additive A is added to and mixed with the toner particle.

H80 is preferably from 65 nm to 120 nm and more preferably from 75 nm to 100 nm where, when a cumulative distribution of the protrusion height H is constructed for the protruded portions having a protrusion height H from 30 nm to 300 nm, H80 is the protrusion height corresponding to 80 number % for cumulation of the protrusion height H from the small side.

The transferability can be further improved by having H80 be in the indicated range.

This H80 can be adjusted into the indicated range, for example, by procedures that control the characteristics of the protruded portion, infra.

The release behavior between the paper and the fixing member in the fixing step where the toner is fixed by the fixing member is improved by the outmigration of a suitable amount of a release agent from the toner base particle.

In an image obtained by observing the toner surface with a scanning electron microscope, acquiring the backscattered electron image for a 1.5-μm square of the toner surface, and binarizing whereby the organosilicon polymer regions in the backscattered electron image become bright regions, the area percentage for the bright region area in the image with reference to the total area of the image (also hereinafter referred to simply as the area percentage for the bright region area) is from 30.0% to 75.0%. From 35.0% to 70.0% is preferred for the area percentage for the bright region area in this image.

A higher area percentage for the bright region area indicates a higher percentage of occurrence for the organosilicon polymer at the toner base particle surface.

When the area percentage for the bright region area is higher than 75.0%, the percentage of occurrence at the toner base particle surface of components that originate with the toner base particle is then small and release agent outmigration from the toner base particle is impeded, and the occurrence of thin paper wraparound at the fixing unit during low-temperature fixing is facilitated as a result.

When, on the other hand, the area percentage for the bright region area in this image is less than 30.0%, the percentage of occurrence at the toner base particle surface of components that originate with the toner base particle is then large. Thus, there is a large area of exposure, at the toner base particle surface, of components originating with the toner base particle and the transferability during initial use is reduced.

This area percentage for the bright region area in the image is also referred to in the following as the coverage ratio by the organosilicon polymer for the toner base particle surface.

This area percentage for the bright region area in the image can be adjusted into the indicated range, for example, by procedures that control the characteristics of the protruded portion, infra.

The external additive A should have a number-average primary particle diameter R of from 30 nm to 1,200 nm, but is not otherwise particularly limited, and various organic fine particles and inorganic fine particles can be used.

The external additive A preferably contains silica fine particles from the standpoints of readily providing flowability and facilitating the same negative charging as the toner base particle. The content of silica fine particles in the external additive A is preferably at least 50 mass %, and the external additive A more preferably consists of silica fine particles.

The content in the toner of the external additive A is preferably from 0.02 mass % to 5.00 mass % and is more preferably from 0.05 mass % to 3.00 mass %.

The following are examples of organic fine particles and inorganic fine particles other than silica fine particles.

(1) Flowability-imparting agents: alumina fine particles, titanium oxide fine particles, carbon black, and fluorinated carbon.

(2) Abrasives: metal oxide fine particles (fine particles of, e.g., strontium titanate, cerium oxide, alumina, magnesium oxide, and chromium oxide), nitride fine particles (fine particles of, e.g., silicon nitride), carbide fine particles (fine particles of, e.g., silicon carbide), and fine particles of metal salts (fine particles of, e.g., calcium sulfate, barium sulfate, and calcium carbonate).

(3) Lubricants: fluororesin fine particles (fine particles of, e.g., vinylidene fluoride and polytetrafluoroethylene) and fine particles of metal salts of fatty acids (fine particles of, e.g., zinc stearate and calcium stearate).

(4) Charge control fine particles: metal oxide fine particles (fine particles of, e.g., tin oxide, titanium oxide, zinc oxide, and alumina) and carbon black.

In order to improve toner flowability and provide uniform toner particle charging, the silica fine particles, the organic fine particles, and the inorganic fine particles may in each instance be used after the execution of a hydrophobic treatment thereon.

The treatment agent for this hydrophobic treatment can be exemplified by unmodified silicone varnishes, variously modified silicone varnishes, unmodified silicone oils, variously modified silicone oils, silane compounds, silane coupling agents, other organosilicon compounds, and organotitanium compounds. A single one or a combination of these treatment agents may be used.

Known silica fine particles may be used for the silica fine particles under consideration, and dry silica fine particles or wet silica fine particles may be used. Wet silica fine particles obtained by the sol-gel method (also referred to as sol-gel silica in the following) are preferred.

Sol-gel silica occurs as spherical and monodisperse, but coalescence may also occur to some degree.

When the full width at half maximum for the peak for the primary particles in the chart of the volume-based particle size distribution is not more than 25 nm, these coalesced particles are scarce and the uniform attachment of the silica fine particles at the toner particle surface is then enhanced and a higher flowability is obtained.

In addition, the silica fine particles preferably having a saturation moisture adsorption at 32.5° C. and a relative humidity of 80.0% of from 0.4 mass % to 3.0 mass %. Controlling into the indicated range serves to suppress moisture adsorption by the porous sol-gel silica even in high-temperature, high-humidity environments and to facilitate the maintenance of a high charging performance. As a consequence, a low-fogging image exhibiting a higher image quality can be obtained during extended print output.

The method for producing sol-gel silica is described in the following.

First, hydrolysis and condensation reactions are run under catalysis on an alkoxysilane in a water-containing organic solvent to obtain a silica sol suspension. The solvent is removed from the silica sol suspension and drying is carried out to yield silica fine particles.

The number-average primary particle diameter of the silica fine particles yielded by the sol-gel method can be controlled using the following in the hydrolysis and condensation reaction step: the reaction temperature; the dropwise addition rate of the alkoxysilane; the mass ratios among the water, organic solvent, and catalyst; and the stirring rate.

The thusly obtained silica fine particles are generally hydrophilic and have numerous surface silanol groups. As a consequence, in the case of use as an external additive for toner, the surface of the silica fine particles is preferably subjected to a hydrophobic treatment.

The method for carrying out the hydrophobic treatment can be exemplified by methods in which treatment with a hydrophobic treatment agent is carried out after removal of the solvent from the silica sol suspension and drying, and methods in which the hydrophobic treatment agent is directly added to the silica sol suspension and the treatment is carried out at the same time as drying. Procedures in which the hydrophobic treatment agent is directly added to the silica sol suspension are preferred from the standpoint of controlling the full width at half maximum for the peak for the primary particles in the chart of the volume-based particle size distribution and from the standpoint of controlling the saturation moisture adsorption.

The hydrophobic treatment agent can be exemplified by the following:

γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, p-methylphenyltrimethoxysilane, methyltriethoxysilane, butyltriethoxysilane, hexyltriethoxysilane, octyltriethoxysilane, decyltriethoxysilane, dodecyltriethoxysilane, phenyltriethoxysilane, o-methylphenyltriethoxysilane, and p-methylphenyltriethoxysilane.

In addition, the silica fine particles may be subjected to a deagglomeration treatment in order to facilitate bringing about a monodispersion of the silica fine particles on the toner particle surface and/or to bring about the expression of a stable spacer effect.

The bulk density of the silica fine particles is preferably from 150 g/L to 300 g/L. When the bulk density of the silica fine particles is in the indicated range, this indicates that the bulk density is very low, with tight packing being suppressed and with the silica fine particles occurring with a large amount of air being present between the fine particles. As a consequence, the mixability between the toner particles and silica fine particles is improved during the external addition step and the generation of a uniform state of coverage is facilitated. In addition, these phenomena are more significant when the toner particle has a high average circularity and an increasing trend appears for the coverage ratio by the silica fine particles. As a result, toner-to-toner tight packing is suppressed for the toner that has undergone external addition, and due to this a reduction in the toner-to-toner attachment force is facilitated.

The means for controlling the bulk density of the silica fine particles into the aforementioned range can be exemplified by regulation of the hydrophobic treatment in the silica sol suspension or regulation of the intensity of the deagglomeration treatment after the hydrophobic treatment, and by adjustment of, e.g., the degree of the hydrophobic treatment. The relatively large agglomerates as such can be reduced through the execution of a uniform hydrophobic treatment. Or, the relatively large agglomerates present in the silica fine particles after drying can be broken down into relatively small particles by regulation of the intensity of the deagglomeration treatment, enabling a reduction in the bulk density.

The organosilicon polymer has a T3 unit structure as represented by $R—Si(O_{1/2})_3$.

R represents an alkyl group having from 1 to 6 carbons or a phenyl group.

In the organosilicon polymer having the T3 unit structure, one of the four valences of the Si atom is bonded to R and the remaining three are bonded to an O atom. The O atom resides in a state in which its two valences are each bonded to Si, thus providing a siloxane bond (Si—O—Si). Considering the Si atom and O atom at the level of the organosilicon polymer, they are represented by $—Si(O_{1/2})_3$ since three O atoms are present for two Si atoms. The $—Si(O_{1/2})_3$ structure of this organosilicon polymer is regarded as having properties similar to those of silica ($SiO_2$), which is constituted of a large number of siloxane bonds.

The R is preferably an alkyl group having 1 to 6 carbons and is more preferably an alkyl group having 1 to 3 carbons.

Preferred examples of the alkyl group having 1 to 3 carbons are the methyl group, ethyl group, and propyl group. R is more preferably the methyl group.

The organosilicon polymer preferably is a condensation polymer of an organosilicon compound having the structure given by the following formula (Z).

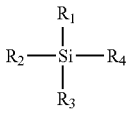

(Z)

In formula (Z), $R_1$ represents a hydrocarbon group (preferably an alkyl group) having 1 to 6 carbons, and $R_2$, $R_3$, and $R_4$ each independently represent a halogen atom, hydroxy group, acetoxy group, or alkoxy group.

$R_1$ is preferably an aliphatic hydrocarbon group having 1 to 3 carbons and is more preferably the methyl group.

$R_2$, $R_3$, and $R_4$ each independently represent a halogen atom, hydroxy group, acetoxy group, or alkoxy group (also referred to herebelow as a reactive group). These reactive groups undergo hydrolysis, addition polymerization, and condensation polymerization, thereby forming a crosslinked structure.

Hydrolysis proceeds gently at room temperature, and, from the standpoint of the deposition behavior onto the surface of the toner base particle, an alkoxy group having 1 to 3 carbons is preferred and the methoxy group and ethoxy group are more preferred.

The hydrolysis, addition polymerization, and condensation polymerization of $R_2$, $R_3$, and $R_4$ can be controlled using the reaction temperature, reaction time, reaction solvent, and pH. A single organosilicon compound having three reactive groups ($R_2$, $R_3$, and $R_4$) in the individual molecule, excluding the $R_1$ in the formula (Z) given above (also referred to as a trifunctional silane in the following), or a combination of a plurality of such organosilicon compounds, may be used in order to obtain the organosilicon polymer.

The following are examples of compounds with formula (Z):

trifunctional methylsilanes such as methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane;

trifunctional silanes such as ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane, and hexyltrihydroxysilane; and trifunctional phenylsilanes such as phenyltrimethoxysilane, phenyltriethoxysilane, phenyltrichlorosilane, phenyltriacetoxysilane, and phenyltrihydroxysilane.

To the extent that the effects of the present disclosure are not impaired, an organosilicon polymer may be used that is obtained using the following in combination with the organosilicon compound having the structure given by the formula (Z): an organosilicon compound having four reactive groups in each molecule (tetrafunctional silane), an organosilicon compound having two reactive groups in each molecule (difunctional silane), or an organosilicon compound having one reactive group (monofunctional silane). Examples thereof are as follows:

dimethyldiethoxysilane, tetraethoxysilane, hexamethyldisilazane, 3-aminopropyltrimethoxysilane, 3-aminopropyltriethoxysilane, 3-(2-aminoethyl)aminopropyltrimethoxysilane, and 3-(2-aminoethyl)aminopropyltriethoxysilane, and trifunctional vinylsilanes such as vinyltriisocyanatosilane, vinyltrimethoxysilane, vinyltriethoxysilane, vinyldiethoxymethoxysilane, vinylethoxydimethoxysilane, vinylethoxydihydroxysilane, vinyldimethoxyhydroxysilane, vinylethoxymethoxyhydroxysilane, and vinyldiethoxyhydroxysilane.

The content of the organosilicon polymer in the toner is preferably from 1.0 mass % to 10.0 mass %.

From the standpoint of the reduction in the attachment force for members and the improvement in the transfer efficiency associated therewith, the fixing percentage of the organosilicon polymer for the toner base particle surface is preferably from 80% to 100%, more preferably from 90% to 100%, and still more preferably from 95% to 100%.

This fixing percentage can be controlled into the indicated range by, for example, adjustment—during the addition and polymerization of the organosilicon compound—of the addition rate of the organosilicon compound, the reaction temperature, the reaction time, the pH during the reaction, and the timing of pH adjustment.

In a preferred method for forming the protruded portion specified hereinabove on the toner base particle surface, the toner base particle is dispersed in an aqueous medium to obtain a toner base particle dispersion, and the organosilicon compound is then added thereto and the protruded portion is formed to yield a toner particle dispersion.

The solids fraction concentration in the toner base particle dispersion is preferably adjusted to from 25 mass % to 50 mass %. The temperature of the toner base particle dispersion is preferably adjusted in advance to at least 35° C. In addition, the pH of the toner base particle dispersion is preferably adjusted to a pH that impedes the progress of condensation by the organosilicon compound. Because the pH that impedes the progress of condensation by the organosilicon compound varies with the particular substance, within ±0.5 centered on the pH at which the reaction is most impeded is preferred.

The use is preferred of an organosilicon compound that has been subjected to a hydrolysis treatment. For example, hydrolysis may be carried out in advance in a separate vessel as a pretreatment for the organosilicon compound. The charge concentration for hydrolysis, using 100 mass parts for the amount of the organosilicon compound, is preferably from 40 mass parts to 500 mass parts and more preferably from 100 mass parts to 400 mass parts of water from which the ionic fraction has been removed, for example, deionized water or RO water. The conditions during hydrolysis are preferably a pH of 2 to 7, a temperature of 15° C. to 80° C., and a time of 30 minutes to 600 minutes.[0042] The resulting hydrolysis solution is mixed with the toner base particle dispersion and adjustment is carried out to a pH suitable for condensation (preferably from 5 to 12 or from 1 to 3 and more preferably from 8 to 12). Formation of the protruded portion is facilitated by adjusting the amount of the hydrolysis solution to from 5.0 mass parts to 30.0 mass parts of the organosilicon compound per 100 mass parts of the toner base particle.

In addition, condensation is preferably carried out by dividing the pH into two stages. For example, the condensation pH in a first stage may be from 4.0 to 6.0 and the condensation pH in a second stage may be from 8.0 to 11.0.

The temperature and time for formation of the protruded portion and condensation is preferably holding for 60 minutes to 72 hours at a temperature of from 35° C. to 99° C.

In order to control the characteristics of the protruded portions on the surface of the toner base particle, the holding time prior to adjustment to the condensation pH of the first stage and the holding time prior to adjustment to the condensation pH of the second stage may be adjusted as appropriate. The characteristics of the protruded portions on the toner base particle surface are readily controlled by adjustment of these holding times. For example, the holding time prior to adjustment of the condensation pH of the first stage may be from 0.10 hour to 1.50 hours and the holding time prior to adjustment to the condensation pH of the second stage may be from 3.0 hours to 5.0 hours.

The characteristics of the protruded portions can also be controlled through adjustment of the condensation temperature for the organosilicon compound in the range from 35° C. to 80° C.

For example, the protrusion width w can be controlled using, e.g., the amount of addition of the organosilicon compound, the reaction temperature, the condensation pH in the first stage, and the reaction time. For example, the protrusion width tends to increase as the condensation time in the first stage is extended.

The protrusion diameter D and protrusion height H can be controlled through, e.g., the amount of addition of the organosilicon polymer, the reaction temperature, and the condensation pH in the second stage. For example, the protrusion diameter D and protrusion height H tend to increase as the condensation pH in the second stage is increased.

Toner production methods are described in the following, but this is not intended as a limitation to or by these.

With regard to the toner particle, the toner base particle may be produced in an aqueous medium and the organosilicon polymer-containing protruded portions may be formed on the surface of this toner base particle. The toner may be produced by the addition/mixing of the external additive A to/with the toner particle using a known method (using, for example, a Henschel mixer, Model FM10C from Nippon Coke & Engineering Co., Ltd., and so forth).

The method for producing the toner base particle can be exemplified by methods in which a resin particle is produced in an aqueous medium, e.g., the suspension polymerization method, dissolution suspension method, and emulsion aggregation method. The suspension polymerization method is preferred among these.

When the suspension polymerization method is used, the uniform deposition of the organosilicon polymer on the surface of the toner base particle is facilitated, an excellent adherence by the organosilicon polymer is obtained, and an excellent environmental stability, an excellent suppression of charge inversion components, and an excellent persistence of the preceding during extended use are provided. The suspension polymerization method is further described in the following.

The suspension polymerization method is a method in which the toner base particle is obtained by granulating a polymerizable monomer composition—comprising a resin-producing polymerizable monomer, a release agent, and other optional additives—in an aqueous medium and polymerizing the polymerizable monomer present in the polymerizable monomer composition.

After the completion of the polymerization step, the produced particles may be washed, recovered by filtration, and dried using known methods to obtain the toner base particle.

The temperature may be raised in the latter half of the polymerization step. In addition, in order to remove unreacted polymerizable monomer and by-products, a portion of the dispersion medium may be distillatively removed from the reaction system in the latter half of the polymerization step or after the completion of the polymerization step.

Preferably the organosilicon polymer protruded portions are formed using the thusly obtained toner base particle and the method described above.

There are no particular limitations on the release agent, and the following known release agents can be used:

petroleum-based waxes such as paraffin waxes, microcrystalline waxes, and petrolatum, and derivatives thereof; montan wax and derivatives thereof; hydrocarbon waxes produced by the Fischer-Tropsch method, and derivatives thereof; polyolefin waxes such as polyethylene and polypropylene, and derivatives thereof; natural waxes such as carnauba wax and candelilla wax, and derivatives thereof; higher aliphatic alcohols; fatty acids such as stearic acid and palmitic acid, and their compounds; acid amide waxes; ester waxes; ketones; hydrogenated castor oil and derivatives thereof; plant waxes; animal waxes; and silicone resins.

The derivatives include oxides as well as block copolymers and graft modifications with vinyl monomers. A single one of these or a mixture may be used.

The release agent content, considered per 100 mass parts of the resin or resin-producing polymerizable monomer, is preferably from 2.0 mass parts to 30.0 mass parts.

The toner base particle may contain a resin. This resin can be exemplified by the following.

Homopolymers of styrene or a derivative thereof, e.g., polystyrene and polyvinyltoluene; styrene copolymers such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleate ester copolymer; as well as polymethyl methacrylate, polybutyl methacrylate, polyvinyl acetate, polyethylene, polypropylene, polyvinyl butyral, silicone resins, polyester resins, polyamide resins, epoxy resins, polyacrylic resins, rosin, modified rosin, terpene resins, phenolic resins, aliphatic hydrocarbon resins, alicyclic hydrocarbon resins, and aromatic petroleum resins. A single one of these may be used, or a mixture of a plurality may be used.

Preferred among the preceding are styrene homopolymers; styrene-acrylic copolymers, e.g., styrene-methyl acrylate copolymers, styrene-ethyl acrylate copolymers, styrene-butyl acrylate copolymers, styrene-octyl acrylate copolymers, and styrene-dimethylaminoethyl acrylate copolymers; and styrene-methacrylic copolymers e.g., styrene-methyl methacrylate copolymers, styrene-ethyl methacrylate copolymers, styrene-butyl methacrylate copolymers, and styrene-dimethylaminoethyl methacrylate copolymers.

The polymerizable monomer can be exemplified by the vinyl polymerizable monomers given below.

Styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; methylene aliphatic monocarboxylic acid esters; vinyl esters such as vinyl acetate, vinyl propionate, vinyl benzoate, vinyl butyrate, and vinyl formate; vinyl ethers such as vinyl methyl ether, vinyl ethyl ether, and vinyl isobutyl ether; as well as vinyl methyl ketone, vinyl hexyl ketone, and vinyl isopropyl ketone. A single one of these may be used, or a mixture of a plurality may be used.

A polymerization initiator may be added to the polymerization of the polymerizable monomer. The following are examples of the polymerization initiator:

azo and diazo polymerization initiators such as 2,2'-azobis (2,4-divaleronitrile), 2,2'-azobisisobutyronitrile, 1,1'-azobis (cyclohexane-1-carbonitrile), 2,2'-azobis-4-methoxy-2,4-dimethylvaleronitrile, and azobisisobutyronitrile; and peroxide polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide. A single one of these may be used, or a mixture of a plurality may be used.

The added amount of the polymerization initiator is preferably from 0.5 mass % to 30.0 mass % with respect to the polymerizable monomer.

A chain transfer agent may be added to the polymerization of the polymerizable monomer in order to control the molecular weight of the resin.

The amount of addition of this chain transfer agent is preferably from 0.001 mass % to 15.000 mass % with reference to the polymerizable monomer.

A crosslinking agent may be added to the polymerization of the polymerizable monomer in order to control the molecular weight of the resin.

Crosslinking monomer can be exemplified by the following. Divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, the diacrylates of polyethylene glycol #200, #400, and #600, dipropylene glycol diacrylate, polypropylene glycol diacrylate, polyester-type diacrylates (MANDA, Nippon Kayaku Co., Ltd.), and crosslinking agents provided by changing the acrylate in the preceding to methacrylate.

Polyfunctional crosslinking monomers can be exemplified by the following: pentaerythritol triacrylate, trimethylolethane triacrylate, trimethylolpropane triacrylate, tetramethylolmethane tetraacrylate, oligoester acrylates and their methacrylates, 2,2-bis(4-methacryloxy•polyethoxyphenyl) propane, diacryl phthalate, triallyl cyanurate, triallyl isocyanurate, triallyl trimellitate, and diallyl chlorendate. A single one of these may be used, or a mixture of a plurality may be used.

The added amount of the crosslinking agent is preferably from 0.001 mass % to 15.000 mass % with respect to the polymerizable monomer.

When the medium used in the aforementioned suspension polymerization is an aqueous medium, the following may be used as a dispersion stabilizer for the particles of the polymerizable monomer composition:

tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina.

The following are examples of organic dispersing agents: polyvinyl alcohol, gelatin, methyl cellulose, methyl hydroxypropyl cellulose, ethyl cellulose, the sodium salt of carboxymethyl cellulose, and starch.

A commercially available nonionic, anionic, or cationic surfactant may also be used.

These surfactants are exemplified by the following: sodium dodecyl sulfate, sodium tetradecyl sulfate, sodium pentadecyl sulfate, sodium octyl sulfate, sodium oleate, sodium laurate, and potassium stearate.

The toner base particle may contain a colorant. There are no particular limitations on these colorant and known colorants may be used.

The colorant content, considered per 100 mass parts of the resin or polymerizable monomer that produces the resin, is preferably from 3.0 mass parts to 15.0 mass parts.

The toner base particle may contain a charge control agent. There are no particular limitations on this charge control agent and known charge control agents may be used.

The charge control agent content, considered per 100 mass parts of the resin or polymerizable monomer that produces the resin, is preferably from 0.01 mass parts to 10.00 mass parts.

The various measurement methods are described in the following. Method for Observing Toner Cross Section with Scanning Transmission Electron Microscope (STEM)

The toner cross section for observation with a scanning transmission electron microscope (STEM) is prepared proceeding as follows.

The procedure for preparing the toner cross section is described in the following.

When organic fine particles or inorganic fine particles have been externally added to the toner, the organic fine particles or inorganic fine particles are removed using, for example, the following method, to yield the sample that is used.

A sucrose concentrate is prepared by the addition of 160 g of sucrose (Kishida Chemical Co., Ltd.) to 100 mL of deionized water and dissolving while heating on a water bath. 31 g of this sucrose concentrate and 6 mL of Contaminon N (a 10 mass % aqueous solution of a neutral pH 7 detergent for cleaning precision measurement instrumentation, comprising a nonionic surfactant, anionic surfactant, and organic builder, Wako Pure Chemical Industries, Ltd.) are introduced into a centrifugal separation tube (50 mL volume). 1.0 g of the toner is added to this, and clumps of the toner are broken up using, for example, a spatula. The centrifugal separation tube is shaken with a shaker (AS-1N, purchased from AS ONE Corporation) for 20 minutes at 300 strokes per minute (spm). After shaking, the solution is transferred over to a glass tube (50 mL) for swing rotor service, and separation is performed with a centrifugal separator (H-9R, Kokusan Co., Ltd.) using conditions of 3,500 rpm and 30 minutes.

This procedure results in the separation of the toner particles from the external additive. Satisfactory separation of the toner particles from the aqueous solution is checked visually, and the toner particles separated into the uppermost layer are recovered with, for example, a spatula. The recovered toner particles are filtered using a reduced pressure filter and are then dried for at least one hour in a dryer to yield the measurement sample. This procedure is carried out a plurality of times to secure the necessary amount.

Whether the protruded portions contain organosilicon polymer is determined by combination with elemental analysis by energy-dispersive x-ray analysis (EDS).

The toner is first broadcast into a single layer on a cover glass (square cover glass, Square No. 1, Matsunami Glass Ind., Ltd.), and an Os film (5 nm) and a naphthalene film (20 nm) are executed thereon as protective films using an Osmium Plasma Coater (OPC80T, Filgen, Inc.).

D800 photocurable resin (JEOL Ltd.) is then filled into a PTFE tube (outer diameter 3 mm (inner diameter 1.5 mm)×3 mm), and the aforementioned cover glass is gently placed on the tube with the toner facing so as to come into contact with the D800 photocurable resin. This assembly is exposed to light and the resin is cured, followed by removal of the cover glass and tube to produce a resin cylinder in which the toner is embedded in the outermost surface side.

Using an ultrasound ultramicrotome (UC7, Leica), cross sections of the center of the toner are generated by slicing, from the surfacemost side of the resin cylinder at a slicing rate of 0.6 mm/s, at just the length of the radius of the toner (for example, 4.0 μm when the weight-average particle diameter (D4) is 8.0 μm).

Thin-section samples of the toner cross section are then prepared by slicing at a film thickness of 100 nm. Cross sections of the center of the toner can be obtained by slicing in accordance with this procedure.

A JEM-2800 from JEOL Ltd. was used as the scanning transmission electron microscope (STEM). An image is acquired using a STEM probe size of 1 nm and an image size of 1024×1024 pixels. The image is acquired by adjusting the Contrast to 1425 and the Brightness to 3750 on the Detector Control panel for the bright-field image and adjusting the Contrast to 0.0, the Brightness to 0.5, and the Gamma to 1.00 on the Image Control panel.

Image magnification is 100,000×, and image acquisition is performed so as to fit approximately from one-fourth to one-half of the circumference of the cross section for one toner particle, as shown in FIG. 1.

The organosilicon polymer-containing protruded portions are measured by subjecting the obtained STEM image to image processing using image processing software (Image J (available from https://imagej.nih.gov/ij/)). This measurement is carried out on 30 protruded portions selected at random from the STEM image.

Whether the protruded portions contain organosilicon polymer is checked by combining the scanning electron microscope (SEM) with elemental analysis by energy-dispersive x-ray analysis (EDS).

First, a line is drawn along the circumference of the toner base particle using the line drawing tool (select Segmented line on the Straight tab). In regions where the organosilicon polymer protruded portion is buried in the toner base particle, the lines are connected as if this burial did not occur, so as to maintain the curvature of the contour line of the toner base particle.

Extension into an extended image is carried out based on this line (Selection on the Edit tab is selected, the line width in properties is changed to 500 pixels, and Selection on the Edit tab is then selected and Straightener is carried out).

The following measurements are carried out on a single organosilicon polymer-containing protruded portion in this extended image.

The length of the line along the circumference for the segment where a protruded portion and the toner base particle form a continuous interface is made the protrusion width w.

The protrusion diameter D designates the maximum length of the protruded portion in the direction perpendicular to the protrusion width w, and the protrusion height H designates the length, in the line segment that forms the protrusion diameter D, from the apex of the protruded portion to the line along the circumference.

This measurement is carried out on 30 randomly selected protruded portions, and the number-average value of the protrusion height H is taken to be the arithmetic average value of the individual measurement values.

Method for Calculating H80

Using the STEM image of the toner cross section taken using the aforementioned scanning transmission electron microscope (STEM), a cumulative distribution of the protrusion height H is constructed for the protruded portions having a protrusion height H from 30 nm to 300 nm, and H80 (unit: nm) is taken to be the protrusion height corresponding to 80 number % for cumulation of the protrusion height H from the small side.

Method for Calculating Area Percentage for Bright Region Area in 1.5-μm Square Backscattered Electron Image of Toner Surface Observation of the toner surface is carried out using a scanning electron microscope to obtain the area percentage for the bright region area. A 1.5-μm square backscattered electron image of the toner surface is acquired; a binarized image is obtained in which the organosilicon polymer regions in this backscattered electron image appear as bright regions; and the percentage for the bright region area in this image with reference to the total area of the image is determined.

The 1.5-μm square backscattered electron image of the toner surface is acquired using a scanning electron microscope (SEM).

When organic fine particles or inorganic fine particles have been externally added to the toner, the organic fine particles or inorganic fine particles are removed using, for example, the following method, to yield the sample that is used.

A sucrose concentrate is prepared by the addition of 160 g of sucrose (Kishida Chemical Co., Ltd.) to 100 mL of deionized water and dissolving while heating on a water bath. 31 g of this sucrose concentrate and 6 mL of Contaminon N (a 10 mass % aqueous solution of a neutral pH 7 detergent for cleaning precision measurement instrumentation, comprising a nonionic surfactant, anionic surfactant, and organic builder, Wako Pure Chemical Industries, Ltd.)

are introduced into a centrifugal separation tube (50 mL volume). 1.0 g of the toner is added to this, and clumps of the toner are broken up using, for example, a spatula. The centrifugal separation tube is shaken with a shaker (AS-1N, purchased from AS ONE Corporation) for 20 minutes at 300 strokes per minute (spm). After shaking, the solution is transferred over to a glass tube (50 mL) for swing rotor service, and separation is performed with a centrifugal separator (H-9R, Kokusan Co., Ltd.) using conditions of 3,500 rpm and 30 minutes.

This procedure results in the separation of the toner particles from the external additive. Satisfactory separation of the toner particles from the aqueous solution is checked visually, and the toner particles separated into the uppermost layer are recovered with, for example, a spatula. The recovered toner particles are filtered using a reduced pressure filter and are then dried for at least one hour in a dryer to yield the measurement sample. This procedure is carried out a plurality of times to secure the necessary amount.

Whether the protruded portions contain organosilicon polymer is determined by combination with elemental analysis by energy-dispersive x-ray analysis (EDS), infra.

The SEM instrument and the observation conditions are as follows.

Instrument used: ULTRA PLUS from Carl Zeiss Microscopy GmbH
Acceleration voltage: 1.0 kV
WD: 2.0 mm
Aperture size: 30.0
Detection signal: EsB (energy selective backscattered electrons)
EsB grid: 800 V
Observation amplification: 50,000×
Contrast: 63.0±5.0% (reference value)
Brightness: 38.0±5.0% (reference value)
Resolution: 1,024×768
Pretreatment: the toner particles are broadcast on carbon tape (vapor deposition is not performed)

The acceleration voltage and EsB grid are set so as to achieve the following items: acquisition of structural data on the surfacemost layer of the toner particle, suppression of charge up of the non-vapor-deposited sample, and selective detection of high-energy backscattered electrons. For the field of observation, the neighborhood of an apex where the toner particle curvature is smallest is selected.

Bright regions in the backscattered electron image were confirmed to be derived from organosilicon polymer by overlaying the backscattered electron image with the element mapping image provided by the energy-dispersive x-ray analysis (EDS) that can be provided by the scanning electron microscope (SEM). The SEM/EDS instrument and the observation conditions are as follows.

Instrument used (SEM): ULTRA PLUS from Carl Zeiss Microscopy GmbH
Instrument used (EDS): NORAN System 7, Ultra Dry EDS Detector from Thermo
Fisher Scientific Inc.
Acceleration voltage: 5.0 kV
WD: 7.0 mm
Aperture size: 30.0
Detection signal: SE2 (secondary electrons)
Observation amplification: 50,000×
Mode: spectral imaging
Pretreatment: the toner particles are broadcast onto carbon tape, platinum sputtering The backscattered electron image is overlaid with the silicon element mapping image acquired by this procedure, and agreement between the silicon atom regions in the mapping image and the bright regions in the backscattered electron image is checked.

The calculation of the area percentage for the bright region area with reference to the total area of the backscattered electron image was accessed through analysis, using ImageJ image processing software (developer: Wayne Rashand), of the backscattered electron image of the toner particle surface yielded by the procedure described in the preceding.

The backscattered electron image is first converted to 8-bit through Type in the Image menu. Then, through Filters in the Process menu, the Median diameter is set to 2.0 pixels to reduce the image noise.

After removing the observation conditions display section displayed underneath the backscattered electron image, the center of the image is approximated and a 1.5-μm square range is selected from the image center of the backscattered electron image using the Rectangle Tool from the toolbar.

Threshold is then selected from Adjust on the Image menu. Default is selected; Auto is clicked; and the binarized image is then obtained by clicking Apply. This procedure causes the bright regions of the backscattered electron image to be displayed as white.

Repeat: removal of the observation conditions display section displayed underneath the backscattered electron image, approximation of the center of the image, and selection of a 1.5-μm square range from the image center of the backscattered electron image using the Rectangle Tool from the toolbar.

Histogram is then selected from the Analyze menu. Using the new Histogram window that opens, the Count value is read (corresponds to the total area of the backscattered electron image). List is clicked and the Count value when the brightness is 0 is read (corresponds to the bright region area in the backscattered electron image). These values are then used to calculate the area percentage for the bright region area with reference to the total area of the backscattered electron image. This procedure is carried out on 10 fields of view for each toner particle undergoing evaluation, and the number-average value is calculated to provide the area percentage (%) for the bright region area of the image with reference to the total area, for the image binarized whereby the organosilicon polymer regions in the backscattered electron image become bright regions.

Method for Identifying Organosilicon Polymer

Identification of the organosilicon polymer is carried out by combining observation with a scanning electron microscope (SEM) with elemental analysis by energy-dispersive x-ray analysis (EDS).

Using an "S-4800 Hitachi Ultrahigh Resolution Field Emission Scanning Electron Microscope" (Hitachi High-Technologies Corporation) scanning electron microscope, the toner is observed in a visual field that has been enlarged by a maximum of 50,000X. Observation of the surface is performed by focusing on the toner particle surface.

EDS analysis is carried out on, e.g., a particle present on the surface, and whether the, e.g., analyzed particle, is organosilicon polymer is determined based on the presence/absence of an Si element peak.

When both organosilicon polymer and silica fine particles are present on the toner particle surface, identification of the organosilicon polymer is performed by comparing the ratio (Si/O ratio) for the Si and O element contents (atomic %) with a standard.

EDS analysis is carried out under the same conditions on a standard for the organosilicon polymer and a standard for the silica fine particles, and the Si and O element contents (atomic %) are obtained for both.

The Si/O ratio for the organosilicon polymer is designated A, and the Si/O ratio for the silica fine particles is designated B. Measurement conditions are selected whereby A is significantly larger than B.

Specifically, the measurement is carried out ten times on each standard under the same conditions, and A and B and their respective arithmetic averages are obtained. Measurement conditions are selected whereby the obtained average values provide A/B>1.1.

When the Si/O ratio of, for example, a particle being scored, is on the A side from [(A+B)/2], the, for example, particle is then scored as an organosilicon polymer.

Tospearl 120A (Momentive Performance Materials Japan LLC) is used as the standard for the organosilicon polymer particles, and HDK V15 (Asahi Kasei Corporation) is used as the standard for the silica fine particles.

Method for Measuring Number-Average Primary Particle Diameter R of External Additive This is performed using the combination of an "S-4800 Hitachi Ultrahigh Resolution Field Emission Scanning Electron Microscope" (Hitachi High-Technologies Corporation) scanning electron microscope and energy-dispersive x-ray analysis (EDS).

External additive particles are randomly photographed in a field of observation enlarged to a maximum of 50,000×, while also using an elemental analysis procedure by EDS as described above.

100 external additive particles are randomly selected from the photographed image; the long diameter of the primary particles of the target external additive particles is measured; and the arithmetic average value thereof is taken to be the number-average primary particle diameter R.

The observation magnification is adjusted as appropriate depending on the size of the external additive particles.

Method for Identifying Composition and Ratios for Constituent Compounds of Organosilicon Polymer NMR is used to identify the composition and ratios for the constituent compounds of the organosilicon polymer present in the toner.

The following procedure is carried out when an external additive, e.g., silica fine particles, is present in the toner in addition to the organosilicon polymer.

1 g of the toner is introduced into a vial and is dissolved and dispersed in 31 g of chloroform. A dispersion is prepared by treatment for 30 minutes using an ultrasound homogenizer for dispersion.

Ultrasound treatment instrument: VP-050 ultrasound homogenizer (TIETECH Co., Ltd.)
Microtip: stepped microtip, 2 mmq end diameter
Position of microtip end: center of glass vial, 5 mm height from bottom of vial
Ultrasound conditions: 30% intensity, 30 minutes During this treatment, the ultrasound is applied while cooling the vial with ice water to prevent the temperature of the dispersion from rising.

The dispersion is transferred to a glass tube (50 mL) for swing rotor service, and centrifugal separation is carried out using a centrifugal separator (H-9R, Kokusan Co., Ltd.) and conditions of 58.33 $S^{-1}$ and 30 minutes. Particles having a high specific gravity, for example, silica fine particles, are present in the lower layer in the glass tube after centrifugal separation. The organosilicon polymer-containing chloroform solution that is the upper layer is recovered and the chloroform is removed by vacuum drying (40° C./24 hours) to obtain the sample.

Using this sample or the organosilicon polymer, the abundance ratio of the constituent compounds of the organosilicon polymer and the proportion of the T3 unit structure represented by R—$Si(O_{1/2})_3$ in the organosilicon polymer are measured and calculated using solid-state $^{29}$Si-NMR.

The hydrocarbon group represented by R is first checked using $^{13}$C-NMR.

Measurement Conditions in $^{13}$C-NMR (Solid State)
Instrument: JNM-ECX500II, JEOL RESONANCE
Sample tube: 3.2 $mm_9$
Sample: the sample or organosilicon polymer
Measurement temperature: room temperature
Pulse mode: CP/MAS
Measurement nucleus frequency: 123.25 MHz ($^{13}$C)
Reference substance: adamantane (external reference: 29.5 ppm)
Sample spinning rate: 20 kHz
Contact time: 2 ms
Delay time: 2 s
Number of scans: 1,024

The hydrocarbon group represented by R is confirmed by this method through the presence/absence of a signal originating with, for example, a silicon atom-bonded methyl group (Si—$CH_3$), ethyl group (Si—$C_2H_5$), propyl group (Si—$C_3H_7$), butyl group (Si—$C_4H_9$), pentyl group (Si—$C_5H_{11}$), hexyl group (Si—$C_6Hi_3$), or phenyl group (Si—$C_6H_5$).

With solid-state $^{29}$Si-NMR, on the other hand, peaks are detected in different shift regions depending on the structure of the functional group bonded to the Si in the constituent compounds of the organosilicon polymer.

The individual peak positions can establish the structures bonded to Si through identification using a reference sample. In addition, the abundance ratio of the individual constituent compounds can be calculated from the obtained peak areas. The percentage for the peak area for the T3 unit structure with reference to the total peak area can be determined by calculation.

The specific measurement conditions for the solid-state $^{29}$S-NMR are as follows.

Instrument: JNM-ECX5002 (JEOL RESONANCE)
Temperature: room temperature
Measurement method: DDMAS method, $^{29}$Si, 45°
Sample tube: zirconia, 3.2 mmq
Sample: filled in powder form into the sample tube
Sample rotation rate: 10 kHz
Relaxation delay: 180 s
Scans: 2,000

After this measurement, peak separation is performed, for the sample or organosilicon polymer, into the following structure X1, structure X2, structure X3, and structure X4 by curve fitting for silane components having different substituents and bonding groups, and their respective peak areas are calculated.

The structure X3 indicated below is the T3 unit structure.

Structure X1:

$$(Ri)(Rj)(Rk)SiO_{1/2} \quad (A1)$$

Structure X2:

$$(Rg)(Rh)Si(O_{1/2})_2 \quad (A2)$$

Structure X3:

$$RmSi(O_{1/2})_3 \quad (A3)$$

-continued

Structure X4:

(A4)

$$Si(O_{1/2})_4$$

Structure X1:

(A1)

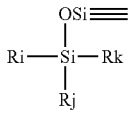

Structure X2:

(A2)

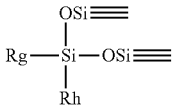

Structure X3:

(A3)

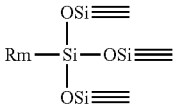

Structure X4:

(A4)

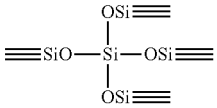

The Ri, Rj, Rk, Rg, Rh, and Rm in formulas (A1), (A2), and (A3) represent a silicon-bonded organic group, e.g., a hydrocarbon group having from 1 to 6 carbons, halogen atom, hydroxy group, acetoxy group, or alkoxy group.

When the structure must be elucidated in greater detail, identification may be performed using the measurement results from the aforementioned $^{13}$C-NMR and $^{29}$Si-NMR in combination with the measurement results from $^{1}$H-NMR.

Method for Quantitating Organosilicon Polymer or Silica Fine Particles Present in Toner The toner is dispersed in chloroform as described above; centrifugal separation is then performed, based on specific gravity differences, of the organosilicon polymer and the external additive, e.g., silica fine particles, and the individual samples are obtained; and the content of the organosilicon polymer or external additive, e.g., silica fine particles, is determined.

The case of silica fine particles for the external additive is used as an example in the following. Other fine particles can be quantitated using the same method.

The pressed toner is first measured using x-ray fluorescence, and the silicon content in the toner is determined by analysis using, for example, a calibration curve method or the FP method.

Then, for the constituent compounds that form the organosilicon polymer and silica fine particles, the structure of each is established using, for example, solid-state $^{29}$Si-NMR and pyrolysis GC/MS, and the silicon content in the organosilicon polymer and in the silica fine particles is determined.

The content of the organosilicon polymer and silica fine particles in the toner is determined by calculation from the relationship between the silicon content in the toner as determined by x-ray fluorescence and the silicon content in the organosilicon polymer and in the silica fine particles as determined by solid-state $^{29}$Si-NMR and pyrolysis GC/MS.

Method for Measuring Fixing Percentage of Organosilicon Polymer or External Additive, e.g., Silica Fine Particles, for Toner Base Particle or Toner Particle, by Water Washing Procedure Water Wash Step 20 g of "Contaminon N" (a 10 mass % aqueous solution of neutral pH 7 detergent for cleaning precision measurement instrumentation, comprising a nonionic surfactant, anionic surfactant, and organic builder) is weighed into a vial with a 50 mL capacity and mixing with 1 g of the toner is carried out.

This is set in a "KM Shaker" (model: V. SX) from Iwaki Sangyo Co., Ltd., and shaking is carried out for 120 seconds with the speed set to 50. This serves to transfer the organosilicon polymer or external additive, e.g., silica fine particles, from the toner base particle or toner particle surface into the dispersion, depending on the state of fixation of the organosilicon polymer or silica fine particles.

The toner is then separated, using a centrifugal separator (H-9R, Kokusan Co., Ltd.) (5 minutes at 16.67 $S^{-1}$), from the organosilicon polymer or external additive, e.g., silica fine particles, that has transferred into the supernatant.

The sedimented toner is dried to solidity by vacuum drying (40° C./24 hours) to provide the post-water-wash toner.

The toner on which this water wash step has not been carried out (pre-water-wash toner) and the toner provided by the water wash step (post-water-wash toner) are imaged using an S-4800 Hitachi Ultrahigh Resolution Field Emission Scanning Electron Microscope (Hitachi High-Technologies Corporation).

The measurement target is identified by elemental analysis using energy-dispersive x-ray analysis (EDS).

The coverage ratio is calculated by analyzing the obtained toner surface image using Image-Pro Plus ver. 5.0 (Nippon Roper KK) image analysis software.

The image acquisition conditions using the S-4800 are as follows.

(1) Specimen Preparation

A conductive paste is thinly coated on the specimen stand (15 mm×6 mm aluminum sample stand) and the toner is sprayed onto this. After the excess toner have been removed from the specimen stand using an air blower, sufficient drying is carried out. The specimen stand is set in the specimen holder and the specimen stand height is adjusted to 36 mm using the specimen height gauge.

(2) Setting Conditions for Observation with S-4800

Measurement of the coverage ratio is performed after having preliminarily discriminated the organosilicon polymer or external additive, e.g., silica fine particles, on the toner surface using elemental analysis by energy-dispersive x-ray analysis (EDS) as described above.

Liquid nitrogen is introduced to the brim of the anti-contamination trap attached to the S-4800 housing and standing for 30 minutes is carried out. The "PC-SEM" of the S-4800 is started and flashing is performed (the FE tip, which is the electron source, is cleaned). The acceleration voltage display area in the control panel on the screen is clicked and the [flashing] button is pressed to open the flashing execution dialog. A flashing intensity of 2 is confirmed and execution is carried out. The emission current due to flashing is confirmed to be 20 to 40 μA. The specimen holder is inserted in the specimen chamber of the S-4800 housing. [home] is pressed on the control panel to transfer the specimen holder to the observation position.

The acceleration voltage display area is clicked to open the HV setting dialog and the acceleration voltage is set to [1.1 kV] and the emission current is set to [20 μA]. In the [base] tab of the operation panel, signal selection is set to [SE]; [upper (U)] and [+BSE] are selected for the SE detector; [L.A.100] is selected in select box of right side of [+BSE]; and the instrument is placed in backscattered electron image observation mode. Similarly, in the [base] tab of the operation panel, the probe current of the electron optical system condition block is set to [Normal]; the focus mode is set to [UHR]; and WD is set to [4.5 mm]. The [ON] button in the acceleration voltage display area of the control panel is pressed to apply the acceleration voltage.

(3) Determination of the Number-Average Particle Diameter (D1) of Toner

The magnification is set to 5,000× (5 k) by dragging within the magnification display area of the control panel. Turning the [COARSE] focus knob on the operation panel, adjustment of the aperture alignment is carried out where some degree of focus has been obtained. [Align] in the control panel is clicked and the alignment dialog is displayed and [beam] is selected. The displayed beam is migrated to the center of the concentric circles by turning the STIGMA/ALIGNMENT knobs (X, Y) on the operation panel. [Aperture] is then selected and the STIGMA/ALIGNMENT knobs (X, Y) are turned one at a time and adjustment is performed so as to stop the motion of the image or minimize the motion. The aperture dialog is closed and focus is performed with the autofocus. Focusing is performed by repeating this operation an additional two times.

The particle diameter is then measured on 300 of the toner and the number-average particle diameter (D1) is determined. The largest diameter during observation of the toner particle is used for the particle diameter of the individual particle.

(4) Focus Adjustment

With the midpoint of the largest diameter—of a particle that is ±0.1 μm from the number-average particle diameter (D1) obtained in (3)—brought into agreement with the center of the measurement screen, dragging is performed within the magnification display area of the control panel to set the magnification to 10,000 (10 k).

Turning the [COARSE] focus knob on the operation panel, adjustment of the aperture alignment is carried out where some degree of focus has been obtained. [Align] in the control panel is clicked and the alignment dialog is displayed and [beam] is selected. The displayed beam is migrated to the center of the concentric circles by turning the STIGMA/ALIGNMENT knobs (X, Y) on the operation panel. [Aperture] is then selected and the STIGMA/ALIGNMENT knobs (X, Y) are turned one at a time and adjustment is performed so as to stop the motion of the image or minimize the motion. The aperture dialog is closed and focus is performed with the autofocus. Then, the magnification is set to 50,000X (50 k) and focus adjustment and focus is performed again with the autofocus using focus knob and STIGMA/ALIGNMENT knobs. Focusing is performed by repeating this operation an additional one time. The measurement accuracy for the coverage ratio readily declines when the plane of observation has a large angle of inclination, and for this reason simultaneous focus of the plane of observation as a whole is selected during focus adjustment and the analysis is carried out with selection of the smallest possible surface inclination.

(5) Image Storage

Brightness adjustment is performed using the ABC mode, and a photograph with a size of 640×480 pixels is taken and saved. Analysis is carried out as follows using this image file. One photograph is taken per one toner, and images are obtained for 25 toner particles.

(6) Image Analysis

The coverage ratio is determined by carrying out binarization, using the analytic software indicated below, of the image yielded by the aforementioned procedure. Here, the single screen described above is partitioned into 12 squares and each is analyzed.

The analysis conditions with the Image-Pro Plus ver. 5.0 image analysis software are as indicated below. However, calculation of the coverage ratio is not performed for those partitions where organosilicon polymer having a particle diameter less than 30 nm or greater than 300 nm, or external additive, e.g., silica fine particles, having a particle diameter less than 30 nm or greater than 1,200 nm is present in the delineated partition.

In the Image-Pro Plus 5.0 image analysis software, "count/size" and then "option" are selected from "measurement" in the toolbar and the binarization conditions are set. 8 connection is selected in the object extraction option and smoothing is set to 0. In addition, pre-filter, hole filling, and enclosure line are not selected, and "exclude boundary line" is set to "none". "measurement item" is selected from "measurement" in the toolbar, and 2 to 10' is input into the area screening range.

The coverage ratio is calculated by outlining a square region. At this time, the area (C) of the region is made from 24,000 to 26,000 pixels. Automatic binarization is performed with "processing"-binarization, and the total (D) of the areas of the regions that are not organosilicon polymer or external additive, e.g., silica fine particles, is calculated.

The coverage ratio is determined using the following formula from the area C of the square region and the total D of the areas of the regions that are not organosilicon polymer or external additive, e.g., silica fine particles.

$$\text{coverage ratio}(\%)=100-(D/C\times 100)$$

The arithmetic average value of all the obtained data is used as the coverage ratio.

The coverage ratio is calculated for both the pre-water-wash toner and the post-water-wash toner, and

[coverage ratio for the post-water-wash toner]/[coverage ratio for the pre-water-wash toner]×100 is used for the "fixing percentage" in the present disclosure.

EXAMPLES

The present disclosure is described in greater detail in the following using examples and comparative examples, but the present disclosure is in no way limited thereto or thereby. The "parts" and "%" used in the examples are on a mass basis unless specifically indicated otherwise.

Examples of toner production are described in the following.

Toner Particle 1 Production Example

Aqueous Medium 1 Preparation 14.0 parts of sodium phosphate (decahydrate, RASA Industries, Ltd.) was introduced into 650.0 parts of deionized water in a reactor fitted with a stirrer, thermometer, and reflux condenser, and this was held for 1.0 hour at 65° C. while purging with nitrogen.

An aqueous calcium chloride solution of 9.2 parts of calcium chloride (dihydrate) dissolved in 10.0 parts of deionized water was introduced all at once while stirring at 15,000 rpm using a T. K. Homomixer (Tokushu Kika Kogyo Co., Ltd.) to prepare an aqueous medium containing a dispersion stabilizer. 10 mass % hydrochloric acid was introduced into the aqueous medium to adjust the pH to 5.0, thus yielding aqueous medium 1.

Preparing Polymerizable Monomer Composition styrene: 60.0 parts

C. I. Pigment Blue 15:3: 6.5 parts

These materials were introduced into an attritor (Mitsui Miike Chemical Engineering Machinery Co., Ltd.) and dispersion was carried out for 5.0 hours at 220 rpm using zirconia particles with a diameter of 1.7 mm. Then, the zirconia particles were removed to prepare a colorant dispersion.

On the other hand, styrene: 20.0 parts n-butyl acrylate: 20.0 parts crosslinking agent (divinylbenzene): 0.3 parts saturated polyester resin: 5.0 parts (polycondensate of propylene oxide-modified bisphenol A (2 mol adduct) and terephthalic acid (10:12 molar ratio), glass transition temperature Tg=68° C., weight-average molecular weight Mw=10,000, molecular weight distribution Mw/Mn=5.12)

Fischer-Tropsch wax (melting point: 78° C.): 7.0 parts

These materials were loaded to the colorant dispersion, and then heated to 65° C., and a polymerizable monomer composition was prepared by dissolving and dispersing to uniformity at 500 rpm using a T. K. Homomixer (Tokushu Kika Kogyo Co., Ltd.).

Granulation Step

Temperature of the aqueous medium 1 is set to 70° C. While holding the rotation rate of the T. K. Homomixer at 15,000 rpm, the polymerizable monomer composition was introduced into the aqueous medium 1 and 10.0 parts of the polymerization initiator t-butyl peroxypivalate was added. Granulation was performed for 10 minutes while maintaining 15,000 rpm with the stirrer.

Polymerization Step and Distillation Step

After the granulation step, the stirrer was changed over to a propeller impeller and polymerization was carried out for 5.0 hours while maintaining 70° C. and stirring at 150 rpm. The temperature was then raised to 85° C. and the polymerization was run for 2.0 hours while holding.

The reflux condenser on the reactor was subsequently changed over to a condenser, and distillation was performed for 6 hours by heating the obtained slurry to 100° C., thereby distilling off the unreacted polymerizable monomer and yielding a resin particle dispersion.

Organosilicon Polymer Forming Step 60.0 parts of deionized water was metered into a reactor fitted with a stirrer and thermometer and the pH was adjusted to 4.0 using 10 mass % hydrochloric acid. This was heated while being stirred to bring the temperature to 40° C. 40.0 parts of the organosilicon compound methyltriethoxysilane was then added and a hydrolysis was carried out for at least 2 hours while stirring.

The end point of the hydrolysis was confirmed by visual observation when oil/water separation was not occurring and one layer was present; cooling then yielded an organosilicon compound hydrolysis solution.

After temperature of the obtained resin particle dispersion had been set to 55° C., 25.0 parts of the organosilicon compound hydrolysis solution was added (added amount of the organosilicon compound was 10.0 parts) and polymerization of the organosilicon compound was initiated. Holding in this condition was carried out for 0.25 hours, followed by adjustment of the pH to 5.5 using a 3.0% aqueous sodium bicarbonate solution. Holding was carried out for 1.0 hour while continuing to stir at 55° C. (condensation reaction 1), after which the pH was adjusted to 9.5 using a 3.0% aqueous sodium bicarbonate solution followed by an additional holding for 4.0 hours (condensation reaction 2) to obtain a toner particle dispersion.

Wash Step and Drying Step

After the completion of the organosilicon polymer formation step, the toner particle dispersion was cooled; hydrochloric acid was added to the toner particle dispersion to adjust the pH to 1.5 or below; and holding was carried out for 1.0 hour while stirring.

A toner cake was then obtained by performing solid/liquid separation using a pressure filter.

The obtained toner cake was reslurried with deionized water to provide another dispersion, and a toner cake was then obtained by solid/liquid separation using the aforementioned filter.

The resulting toner cake was transferred to a thermostatted chamber at 40° C. and was dried over 72 hours and classified to obtain a toner particle 1. The conditions for the production of toner particle 1 are given in Table 1.

Toner Particles 2 to 11 and Comparative Toner Particles 2 to 9 Production Example Toner particles 2 to 11 and comparative toner particles 2 to 9 were obtained proceeding as in the Toner Particle 1 Production Example, but changing to the conditions shown in Table 1. The production conditions for toner particles 2 to 11 and comparative toner particles 2 to 9 are given in Table 1.

TABLE 1

| Toner particle | Type of organosilicon | Amount of addition | Holding time | Condensation reaction 1 | | Condensation reaction 2 | | Temp. |
|---|---|---|---|---|---|---|---|---|
| No. | compound | (parts) | (hr) | pH | hr | pH | hr | (° C.) |
| 1 | Methyltriethoxysilane | 10.0 | 0.25 | 5.5 | 1.0 | 9.5 | 4.0 | 55 |
| 2 | Methyltriethoxysilane | 12.0 | 0.25 | 5.5 | 1.0 | 9.5 | 4.0 | 55 |
| 3 | Methyltriethoxysilane | 16.0 | 0.25 | 5.5 | 1.0 | 9.5 | 4.0 | 55 |
| 4 | Methyltriethoxysilane | 10.0 | 0.25 | 7.0 | 1.5 | 9.5 | 3.5 | 55 |
| 5 | Methyltriethoxysilane | 12.0 | 0.25 | 7.0 | 1.5 | 9.5 | 3.5 | 55 |
| 6 | Methyltriethoxysilane | 16.0 | 0.25 | 7.0 | 1.5 | 9.5 | 3.5 | 55 |
| 7 | Methyltriethoxysilane | 12.0 | 0.25 | 7.0 | 3.5 | 9.5 | 1.5 | 55 |
| 8 | Methyltriethoxysilane | 16.0 | 0.25 | 4.0 | 1.0 | 9.5 | 3.5 | 55 |
| 9 | Methyltriethoxysilane | 16.0 | 0.25 | 4.0 | 2.0 | 9.5 | 3.0 | 55 |
| 10 | Methyltrimethoxysilane | 16.0 | 0.25 | 4.0 | 2.0 | 9.5 | 3.0 | 55 |
| 11 | Methyltrimethoxysilane | 16.0 | 0.25 | 4.0 | 2.0 | 9.5 | 3.0 | 55 |
| Comparative 1 | None used | | | | — | | | |
| Comparative 2 | Methyltrimethoxysilane | 5.0 | 1.00 | 9.5 | 5.0 | — | — | 70 |

TABLE 1-continued

| Toner particle No. | Type of organosilicon compound | Amount of addition (parts) | Holding time (hr) | Condensation reaction 1 pH | Condensation reaction 1 hr | Condensation reaction 2 pH | Condensation reaction 2 hr | Temp. (° C.) |
|---|---|---|---|---|---|---|---|---|
| Comparative 3 | Methyltriethoxysilane | 19.0 | 1.00 | 9.5 | 5.0 | 9.5 | 4.0 | 70 |
| Comparative 4 | Methyltriethoxysilane | 8.5 | 0.25 | 5.7 | 1.0 | 9.5 | 3.5 | 55 |
| Comparative 5 | Methyltriethoxysilane | 8.5 | 0.25 | 5.7 | 1.0 | 9.5 | 3.5 | 55 |
| Comparative 6 | Methyltriethoxysilane | 4.5 | 0.25 | 7.0 | 1.0 | 9.5 | 3.5 | 55 |
| Comparative 7 | Methyltriethoxysilane | 16.0 | 1.00 | 5.5 | 1.0 | 7.0 | 3.5 | 55 |
| Comparative 8 | Methyltriethoxysilane | 4.0 | 1.00 | 9.5 | 5.0 | — | — | 65 |
| Comparative 9 | Methyltriethoxysilane | 19.0 | 0.25 | 5.5 | 1.5 | 9.5 | 4.0 | 55 |

External Additives A1 to A6 and A8 to A11 Production Example

External additives A1 to A6 and A8 to A11 were produced as follows.

150 parts of 5% aqueous ammonia was introduced into a 1.5-L glass reactor fitted with a stirrer, dropwise addition nozzle, and thermometer, and was used as an alkali catalyst solution.

This alkali catalyst solution was adjusted to 50° C.; 100 parts of tetraethoxysilane and 50 parts of 5% aqueous ammonia were added dropwise at the same time while stirring; and a reaction was run for 8 hours to obtain a silica fine particle dispersion. The resulting silica fine particle dispersion was then dried by spray drying and deagglomeration was performed with a pin mill to obtain silica fine particles.

External additives A1 to A6 and A8 to A11, which had different number-average primary particle diameters R, were obtained by appropriate alterations of these production conditions. The properties of external additives A1 to A6 and A8 to All are given in Table 2.

External Additive A7 Production Example

AKP-30 alumina (Sumitomo Chemical Co., Ltd.) was used as external additive A7. The properties of external additive A7 are given in Table 2.

TABLE 2

| Externa additive No. | Type | Number-average primary particle diameter R (nm) |
|---|---|---|
| A1 | Silica | 120 |
| A2 | Silica | 200 |
| A3 | Silica | 60 |
| A4 | Silica | 170 |

TABLE 2-continued

| Externa additive No. | Type | Number-average primary particle diameter R (nm) |
|---|---|---|
| A5 | Silica | 1100 |
| A6 | Silica | 70 |
| A7 | Alumina | 200 |
| A8 | Silica | 100 |
| A9 | Silica | 30 |
| A10 | Silica | 20 |
| A11 | Silica | 1300 |

Toner 1 Production Example 100.00 parts of toner particle 1 and 1.00 parts of external additive A1 were introduced into a Henschel mixer (Model FM10C, Nippon Coke & Engineering Co., Ltd.) that had 7° C. water injected into its jacket. Then, after the water temperature in the jacket had stabilized at 7° C.±1° C., mixing was carried out for 10 minutes using 38 msec for the peripheral velocity of the rotating blades. During this mixing, the amount of the water flowing through the jacket was adjusted as appropriate to prevent the temperature in the chamber of the Henschel mixer from exceeding 25° C.

The resulting mixture was screened across a mesh with an aperture of 75 to obtain toner 1. The production conditions and properties for toner 1 are given in Table 3.

Toners 2 to 11 and Comparative Toners 2 to 9 Production Example

Toners 2 to 11 and comparative toners 2 to 9 were obtained proceeding as in the Toner 1 Production Example, but changing to the external additive A shown in Table 3 and changing the external addition conditions with the Henschel mixer as appropriate. The production conditions and properties for toners 2 to 11 and comparative toners 2 to 9 are given in Table 3.

TABLE 3

| Toner No. | Toner particle No. | Number-average value of protrusion height H (nm) | H80 (nm) | Area percentage for bright region area (%) | Fixing percentage for organosilicon polymer (%) | External additive No. | Type | Number-average primary particle diameter R of external additive A (nm) | X | Fixing percentage for external additive A (%) |
|---|---|---|---|---|---|---|---|---|---|---|
| 1 | 1 | 50 | 75 | 60.0 | 99 | A1 | Silica | 120 | 2.40 | 7 |
| 2 | 2 | 55 | 80 | 50.0 | 98 | A2 | Silica | 200 | 3.64 | 7 |
| 3 | 3 | 50 | 85 | 35.0 | 97 | A3 | Silica | 60 | 1.20 | 7 |
| 4 | 4 | 40 | 80 | 74.0 | 99 | A3 | Silica | 60 | 1.50 | 7 |
| 5 | 5 | 45 | 85 | 34.0 | 98 | A4 | Silica | 170 | 3.78 | 7 |
| 6 | 6 | 50 | 90 | 73.0 | 95 | A4 | Silica | 170 | 3.40 | 7 |
| 7 | 7 | 30 | 90 | 60.0 | 91 | A8 | Silica | 100 | 3.33 | 7 |
| 8 | 8 | 65 | 75 | 60.0 | 84 | A6 | Silica | 70 | 1.08 | 7 |
| 9 | 9 | 60 | 70 | 60.0 | 94 | A1 | Silica | 120 | 2.00 | 20 |

TABLE 3-continued

| Toner No. | Toner particle No. | Number-average value of protrusion height H (nm) | H80 (nm) | Area percentage for bright region area (%) | Fixing percentage for organosilicon polymer (%) | External additive No. | Type | Number-average primary particle diameter R of external additive A (nm) | X | Fixing percentage for external additive A (%) |
|---|---|---|---|---|---|---|---|---|---|---|
| 10 | 10 | 60 | 70 | 60.0 | 94 | A1 | Silica | 120 | 2.00 | 10 |
| 11 | 11 | 65 | 70 | 60.0 | 92 | A7 | Alumina | 200 | 3.08 | 7 |
| Comparative 1 | Comparative 1 | — | — | — | — | A8 | Silica | 100 | — | 65 |
| Comparative 2 | Comparative 2 | 25 | 30 | 50.0 | 78 | A3 | Silica | 60 | 2.40 | 10 |
| Comparative 3 | Comparative 3 | 400 | 410 | 50.0 | 85 | A5 | Silica | 1100 | 2.75 | 10 |
| Comparative 4 | Comparative 4 | 50 | 65 | 40.0 | 99 | A9 | Silica | 30 | 0.60 | 7 |
| Comparative 5 | Comparative 5 | 50 | 65 | 40.0 | 99 | A5 | Silica | 1100 | 22.00 | 7 |
| Comparative 6 | Comparative 6 | 20 | 25 | 40.0 | 99 | A10 | Silica | 20 | 1.00 | 7 |
| Comparative 7 | Comparative 7 | 330 | 340 | 60.0 | 99 | A11 | Silica | 1300 | 3.94 | 7 |
| Comparative 8 | Comparative 8 | 35 | 40 | 25.0 | 86 | A8 | Silica | 100 | 2.86 | 10 |
| Comparative 9 | Comparative 9 | 40 | 45 | 80.0 | 98 | A8 | Silica | 100 | 2.50 | 10 |

The "X" in the table indicates the ratio of the number-average primary particle diameter R of the external additive A to the number-average value of the protrusion height H.

Comparative Toner Particle 1 Production Example

Comparative toner particle 1 was obtained proceeding as in the Toner Particle 1 Production Example, but without performing the "Organosilicon Polymer Formation Step". The production conditions for comparative toner particle 1 are given in Table 1.

Comparative Toner 1 Production Example 100.00 parts of comparative toner particle 1 and 1.00 parts of external additive A8 were introduced into a Henschel mixer (Model FM10C, Nippon Coke & Engineering Co., Ltd.) that had 7° C. water injected into its jacket. Then, after the water temperature in the jacket had stabilized at 7° C.±1° C., mixing was carried out for 10 minutes using 38 m/sec for the peripheral velocity of the rotating blades. During this mixing, the amount of the water flowing through the jacket was adjusted as appropriate to prevent the temperature in the chamber of the Henschel mixer from exceeding 25° C.

The resulting mixture was screened across a mesh with an aperture of 75 μm to obtain comparative toner 1. The production conditions and properties for comparative toner 1 are given in Table 3.

Example 1

The following evaluations were carried out on toner 1. The results are given in Table 4.

Evaluation of Transferability

A modified version of an LBP7700C, a commercial laser beam printer from Canon, Inc., was used as the evaluation machine. The modification consisted of providing the developing roller with a rotation velocity of 360 mm/sec by changing the main unit of the evaluation machine and changing the software.

The toner was filled into a toner cartridge for the LBP7700C and this toner cartridge was held for 24 hours in a normal-temperature, normal-humidity environment (25° C., 50% RH; also referred to below with N/N).

After this standing for 24 hours in the indicated environment, the toner cartridge was installed in the aforementioned machine and 7,500 prints of an image having a print percentage of 5.0% were printed out in the N/N environment in the horizontal direction in the center of A4 paper leaving 50-mm right and left margins.

For the evaluation, a solid image was output at the start of use (after the first print) and after the 7,500th print (after extended use), and the untransferred toner on the photosensitive member when the solid image was formed was overtaped and stripped off using a transparent polyester pressure-sensitive adhesive tape.

A density difference was calculated by subtracting the density for only the pressure-sensitive adhesive tape applied onto paper, from the density for the application of the stripped-off pressure-sensitive adhesive tape onto paper.

The density measurement was carried out at five locations and the arithmetic average value thereof was determined. The evaluation was carried out as follows based on this density difference value.

The density was measured using an X-Rite color reflection densitometer (X-Rite 500 Series, X-Rite, Incorporated).

Evaluation Criteria

A: the density difference is less than 0.030

B: the density difference is at least 0.030, but less than 0.050

C: the density difference is at least 0.050, but less than 0.100

D: the density difference is equal to or greater than 0.100

Evaluation of Low-Temperature Fixability

A modified version of an LBP9600C, a laser beam printer from Canon, Inc., was used as the evaluation machine; the modification enabled the fixation temperature of the fixing unit to be adjusted.

Using this modified machine, the fixation temperature was changed in 5° C. steps from 140° C. in a normal-temperature, normal-humidity environment (25° C., 50% RH; also referred to below with N/N) at a process speed of 300 mm/sec.

Other conditions were as follows: a solid image having a toner laid-on level of 0.40 mg/cm$^2$ was produced on the image-receiving paper, and heat and pressure were applied in an oilless configuration.

Printing was carried out under the conditions indicated above and the status of paper transport was visually checked. The lowest temperature of the fixing unit at which wraparound during paper transport did not occur was determined, and the wraparound behavior (low-temperature fixability) during low-temperature fixing was determined based on the following criteria.

GF-600 (areal weight=60 g/m$^2$, sold by Canon Marketing Japan Inc.) was used as the image-receiving paper.

Evaluation Criteria

A: 140° C. or 145° C.

B: 150° C.

C: 155° C.

D: 160° C. or 165° C.

E: 170° C. or above

Evaluation of Flowability (Solid Compliance)

The solid compliance in a high-temperature, high-humidity environment was evaluated using the following method.

The previously described modified version of a commercial LBP7700C laser beam printer from Canon, Inc. was used as the evaluation machine.

The toner-filled cartridge and the main unit were held for at least 24 hours in a high-temperature, high-humidity environment (temperature=32.5° C., humidity=80% RH). Three prints of a solid image were then continuously output to provide the sample images, and the solid compliance was evaluated by visual evaluation on the third print of the obtained solid images.

10,000 prints at a 1% print percentage were also made in one day using a continuous paper feed; holding in the machine was then carried out for one day; and the solid compliance was evaluated as above after the holding period. The evaluation criteria are given below.

In this evaluation, it is known that better results are obtained at higher toner flowabilities.

The evaluation was carried out at each 10,000 prints, and consecutive evaluations were performed to 30,000 prints.

The following evaluation criteria are the criteria for the consecutive evaluations to 30,000 prints.

Evaluation Criteria

A: uniform with no non-uniformity in the image density

B: minor non-uniformity in the image density is present, but the level does not pose a problem with regard to use C: non-uniformity in the image density is present, but the level does not pose a problem with regard to use D: non-uniformity in the image density is present, at a level that does not provide a uniform solid image Examples 2 to 11 and Comparative Examples 1 to 9

Evaluations were performed proceeding as in Example 1, but changing toner 1 to toners 2 to 11 and comparative toners 1 to 9. The results are given in Table 4.

TABLE 4

| | | Transferability | | | | | |
|---|---|---|---|---|---|---|---|
| | | Initial | | After 7,500 pints | | Low-temperature | |
| | Toner No. | Density difference | Score | Density difference | Score | fixability Score | Flowability Score |
| Example 1 | 1 | 0.018 | A | 0.018 | A | A | A |
| Example 2 | 2 | 0.009 | A | 0.010 | A | A | A |
| Example 3 | 3 | 0.034 | B | 0.098 | C | A | A |
| Example 4 | 4 | 0.016 | A | 0.016 | A | C | A |
| Example 5 | 5 | 0.031 | B | 0.091 | C | A | A |
| Example 6 | 6 | 0.006 | A | 0.062 | C | C | A |
| Example 7 | 7 | 0.014 | A | 0.062 | C | A | A |
| Example 8 | 8 | 0.038 | B | 0.049 | B | A | A |
| Example 9 | 9 | 0.034 | B | 0.042 | B | A | B |
| Example 10 | 10 | 0.025 | A | 0.042 | B | A | A |
| Example 11 | 11 | 0.028 | A | 0.088 | C | A | C |
| Comparative Example 1 | Comparative 1 | 0.052 | C | 0.506 | D | A | A |
| Comparative Example 2 | Comparative 2 | 0.150 | D | 0.320 | D | A | A |
| Comparative Example 3 | Comparative 3 | 0.052 | C | 0.283 | D | A | A |
| Comparative Example 4 | Comparative 4 | 0.035 | B | 0.412 | D | A | A |
| Comparative Example 5 | Comparative 5 | 0.038 | B | 0.094 | C | A | D |
| Comparative Example 6 | Comparative 6 | 0.032 | B | 0.357 | D | A | A |
| Comparative Example 7 | Comparative 7 | 0.037 | B | 0.094 | C | A | D |
| Comparative Example 8 | Comparative 8 | 0.150 | D | 0.365 | D | A | A |
| Comparative Example 9 | Comparative 9 | 0.038 | B | 0.049 | B | D | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-048540, filed Mar. 15, 2019, Japanese Patent Application No. 2020-017058, filed Feb. 4, 2020, which are hereby incorporated by reference herein in their entirety.

What is claimed is:

1. A toner, comprising:

a toner particle that contains a release agent-containing toner base particle, and having an organosilicon polymer on a surface of the toner base particle, the organosilicon polymer having a T3 unit structure represented by $R—Si(O_{1/2})_3$, where R represents a phenyl group or an alkyl group having 1 to 6 carbons, and the organosilicon polymer forming protruded portions on the surface of the toner base particle; and an external additive A, the number-average primary particle diameter R of the external additive A is from 30 nm to 1,200 nm, wherein in an extended image of a toner cross-sectional image obtained with a scanning transmission electron microscope provided by extending a line along the circumference of the surface of the toiler base particle into a straight line, where w is a protrusion width for the length of the line along the circumference for a segment where a protruded portion and the toner base particle form a continuous interface, D is a protrusion diameter for the maximum length of the protruded portion in the direction normal to protrusion width w and H is a protrusion height for the length from the peak of the protruded portion to the line along the circumference in the line segment that forms protrusion diameter D, the number-average value of protrusion height H is 30 to 300 nm, the ratio of the number-average primary particle diameter R of external additive A to the number-average value of protrusion height H is 1.00 to 4.00, and the area percentage for a bright region area with reference to the total area of the image is 30.0 to 75.0% in an image obtained by observing the surface of the toner with a scanning electron microscope, acquiring the backscattered electron image for a 1.5-μm square of the surface of the toner, and binarizing whereby the organosilicon polymer regions in the backscattered electron image become bright regions.

2. The toner according to claim 1, wherein the fixing percentage of external additive A for the surface of the toner particle is 0 to 20%.

3. The toner according to claim 1, wherein external additive A comprises silica fine particles.

4. The toner according to claim 1, wherein the fixing percentage of the organosilicon polymer for the surface of the toner base particle is 80 to 100%.

5. The toner according to claim 1, wherein H80 is 65 to 120 nm when a cumulative distribution of the protrusion height H is constructed for the protruded portions having a protrusion height H from 30 to 300 nm and H80 is the protrusion height corresponding to 80 number % for cumulation of the protrusion height H from the small side.

* * * * *